US010415866B2

(12) United States Patent
Brabenec et al.

(10) Patent No.: US 10,415,866 B2
(45) Date of Patent: Sep. 17, 2019

(54) ICE MAKER

(71) Applicant: BSH-HAUSGERAETE GMBH, Munich (DE)

(72) Inventors: Bernd Brabenec, Giengen (DE); Adolf Feinauer, Giengen (DE); Karl-Friedrich Laible, Langenau (DE)

(73) Assignee: BSH Hausgeraete GmbH, Munich (DE)

( * ) Notice: Subject to any disclaimer, the term of this patent is extended or adjusted under 35 U.S.C. 154(b) by 54 days.

(21) Appl. No.: 15/318,058

(22) PCT Filed: Jun. 11, 2015

(86) PCT No.: PCT/EP2015/062999
§ 371 (c)(1),
(2) Date: Dec. 12, 2016

(87) PCT Pub. No.: WO2015/197367
PCT Pub. Date: Dec. 30, 2015

(65) Prior Publication Data

US 2017/0122638 A1 May 4, 2017

(30) Foreign Application Priority Data

Jun. 24, 2014 (DE) ..... 10 2014 212 121

(51) Int. Cl.
*F25C 1/24* (2018.01)
*F25C 5/06* (2006.01)
*F25D 3/08* (2006.01)

(52) U.S. Cl.
CPC ..... *F25C 1/24* (2013.01); *F25C 5/06* (2013.01); *F25D 3/08* (2013.01); *F25C 2305/022* (2013.01); *F25C 2400/06* (2013.01); *F25C 2400/10* (2013.01)

(58) Field of Classification Search
None
See application file for complete search history.

(56) References Cited

U.S. PATENT DOCUMENTS 2,212,405 A * 8/1940 Rose ..... F25C 1/10 62/233
2,545,558 A * 3/1951 Russell et al. ..... F25C 1/04 62/135
7,204,092 B2 * 4/2007 Azcarate Castrellon ..... F25C 1/04 62/72

(Continued)

FOREIGN PATENT DOCUMENTS

DE 10261353 A1 7/2004
WO 2011080095 A2 7/2011

OTHER PUBLICATIONS

Translation of German Patent Description DE10261353.*
Translation of Description WO2011080095.*

*Primary Examiner* — Allen J Flanigan
(74) *Attorney, Agent, or Firm* — Laurence A. Greenberg; Werner H. Stemer; Ralph E. Locher

(57) ABSTRACT

In an ice maker with a tray having at least one water-receiving cavity, a wall of the cavity contains a phase change material. If an ice maker of this kind is pre-cooled, so that the phase change material is solid, a great deal of heat can be removed from water poured into the cavities in a short time by the heat causing the phase change material to melt.

13 Claims, 2 Drawing Sheets

(56) References Cited

U.S. PATENT DOCUMENTS

| | | | | |
|---|---|---|---|---|
| 7,665,316 | B2 * | 2/2010 | Ito | F25C 1/22 62/135 |
| 7,841,203 | B2 * | 11/2010 | Yoon | F25C 1/04 249/118 |
| 2008/0092582 | A1 * | 4/2008 | Doran | F25D 25/005 62/381 |

* cited by examiner

ICE MAKER

BACKGROUND OF THE INVENTION

Field of the Invention

The present invention relates to an ice maker and a refrigeration appliance, in particular a domestic refrigeration appliance, in which an ice maker of this kind can be used.

Simple ice makers in the form of flat trays made of aluminum or plastic, in which cavities to be filled with water are formed and which can be placed in a freezer compartment of a refrigeration appliance in order to produce ice cubes in the cavities, have been widely used as accessories for domestic refrigeration appliances for decades.

Automatically functioning ice makers have become increasingly popular with consumers. In some of these ice makers, a tray in which the ice cubes are produced is suspended in a frame and can be pivoted by a motor between a freezing position, in which the cavities of the tray are open upward, and an ejection position, in which they are open downward and in which the tray can be twisted by the motor, in order to release the ice cubes from the cavities and allow them to fall into a container arranged below the tray.

In most households, ice is not needed continuously, but when it is required, it is often needed in large amounts. In order to keep a large amount of ice available, the container can be enlarged, but this reduces the volume inside the refrigeration appliance which can be used for other refrigerated goods. Another option for covering sudden high demand is to boost the speed of the ice production. This is essentially determined by the speed of the heat exchange between the surroundings of the tray and the water located therein. The heat exchange between tray and surroundings can be boosted by the temperature being reduced by cold air supplied to the ice maker, which impairs the energy efficiency of the refrigeration appliance, or by increasing the circulation speed of the air, which encourages the evaporation and undesirable frost buildup at other places in the refrigeration appliance. Therefore, none of these options are entirely satisfactory.

BRIEF SUMMARY OF THE INVENTION

It is an object of the invention to create an ice maker with which a high productivity can be achieved at least temporarily and the disadvantages described above can be avoided.

The object is achieved, for an ice maker with a tray having at least one cavity for receiving water, by a wall of the cavity containing a phase change material. If an ice maker of this kind is pre-cooled, so that the phase change material is solid, a great deal of heat can be removed from water poured into the cavities in a short time, by said heat causing the phase change material to melt.

For this purpose, the freezing temperature of the phase change material should preferably be a few degrees below 0° C., preferably at −5° C. or below.

On the other hand, the freezing temperature of the phase change material should be considerably higher than the evaporator temperature of the refrigeration appliance when the ice maker is used, as otherwise the time required for freezing the phase change material would be very long. A freezing temperature of below −20° C. is therefore not expedient; temperatures in the range of −10 to −5° C. are preferred.

The phase change material can be embedded in a matrix material of the wall. Such an embedding can take place on a molecular level, for example by the phase change material being mixed with the material of the matrix and the resulting mixture being molded to the tray. In this case, it can be expedient for the tray to be provided with a coating which is impermeable for the phase change material, in order to prevent the phase change material from being lost during the use of the ice maker.

The embedding can also consist in mixing the phase change material into the matrix material as a granulate. By virtue of the granulate structure being held at temperatures above the melting point of the phase change material, the granulate can be formed by beads filled with the phase change material, the dimensions thereof being small compared to the wall thickness of the tray.

According to a second embodiment, the wall is embodied as a hollow body, which can receive the phase change material.

In order to boost the production capacity of the ice maker, the tray of the ice maker can be configured in multiple parts, in particular the wall of one cavity can comprise a watertight inner shell and a cooling element removably fastened to the shell and containing the phase change material. Thus, the cooling element can be removed when its cooling capacity is exhausted, in order to enable a faster emission of heat of the water to the surroundings, or the exhausted cooling element can be replaced by a fresh cooling element.

A further possibility for boosting the production capacity of the ice maker, is providing a second tray and a shelf, in which the trays are held. While one of the trays is located in a freezing position suitable for ice production, the other can assume a standby position. Ice production does not need to be possible in said standby position; in particular if the tray in the standby position is empty, it can also exchange heat with its surroundings via the interior of the cavities, so that its phase change material is quickly re-frozen and is ready for a further ice production cycle as a result.

The movement of the trays between freezing position and standby position can in particular comprise a pivoting about a horizontal axis.

The trays should at least partly overlap in a top view, in order to keep the space requirement of the ice maker low.

The shelf can have an ejection opening for ice cubes on an underside. A collecting vessel can be provided therebelow.

In order to release finished ice cubes from the tray in the freezing position, the tray can be pivotable about an axis in an ejection position and twisted in said ejection position.

In order to ensure that the ice cubes released from the tray can reach the ejection opening, the tray in the freezing position can in each case be arranged below the tray in the standby position.

In this case, an axis about which the tray can be pivoted into the ejection position can also be the axis about which the tray can be twisted. As a result, the same drive mechanism can serve both the driving of the pivoting movement and also the twisting, which simplifies the configuration of the ice maker.

According to another embodiment, the tray in the freezing position is arranged above the tray in the standby position.

In order to be able to eject finished ice cubes through the tray in the standby position unhindered, the tray in the freezing position should be able to be moved into an ejection position below the tray in the standby position.

The subject matter of the invention also comprises a refrigeration appliance having an ice maker as described above.

Further features and advantages of the invention will emerge from the description of exemplary embodiments provided below, with reference to the attached figures.

DESCRIPTION OF THE INVENTION

Figure 1:
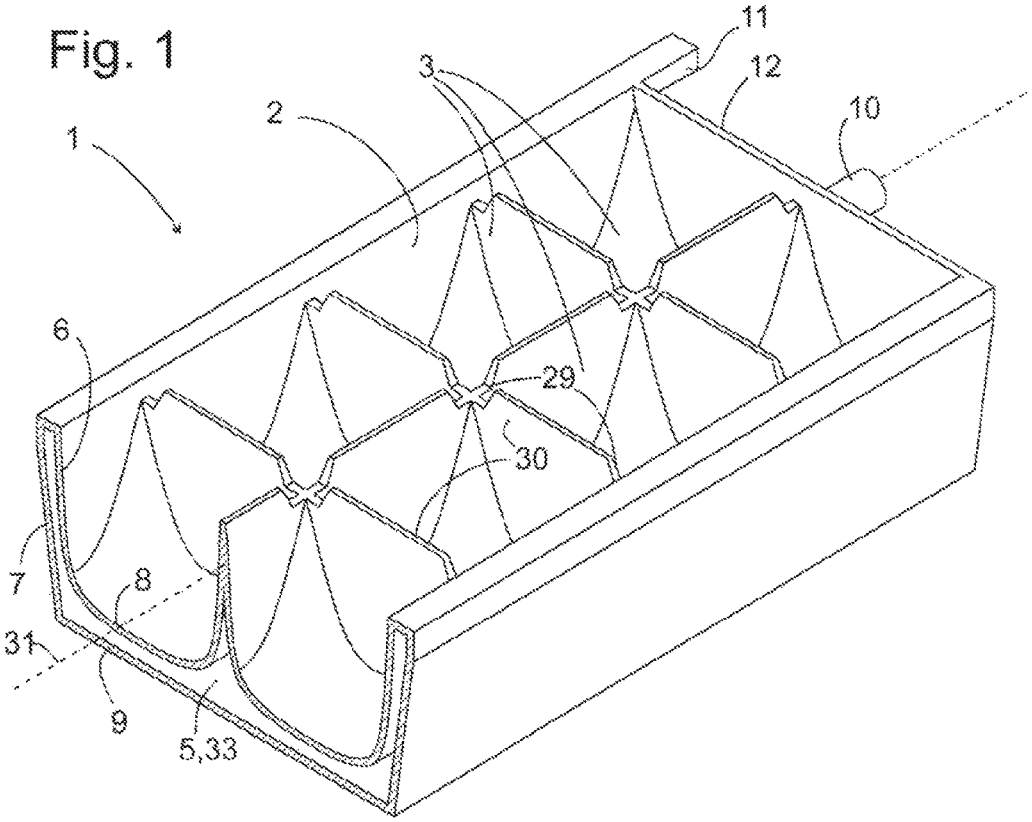
FIG. 1 shows a partly sectional, partly perspective view of an ice maker tray according to a first embodiment of the invention.

FIG. 1 shows a sectional perspective view of an ice maker tray 1 according to a first embodiment of the invention. The tray 1 is an assembly of an inner shell 2, which is divided into two rows of cavities 3 which can be filled with water, and an undivided outer shell 4. The shells 2, 4 are connected in a sealed manner along their edges, e.g. fused or adhered, in order to form a hollow space 5, which extends between side walls 6, 7 and bases 8, 9 of the shells 2, 4 continuously over the entire length and width of the shells 2, 4. It is also conceivable to manufacture the two shells 2, 4 in one continuous piece, in particular by blow molding. The hollow space 5 is filled with a phase change material 33, typically a paraffin.

The tray 1 can be freely placed in a freezer compartment of a domestic refrigeration appliance and thus can be used individually as a non-automatic ice maker; preferably it is a component of an automatic ice maker, the configuration and functionality of which will be explained in more detail with reference to FIGS. 4 and 5.

A plurality of projections are formed on the end faces of the tray 1. Both end faces have a central cylindrical peg 10, which is provided to engage with a bearing of the automatic ice maker and define a pivot axis 31 of the tray 1; the end face 12 shown in FIG. 1 also supports an abutment projection 11, which is provided to block a further rotation of the end face 12 of the tray shown in the Figure after pivoting the tray 1 into an ejection position, in which the openings of the cavities 3 face downward, so that, when a motor engaging on the opposing end face rotates further, the tray 1 is intrinsically twisted and the ice cubes located inside are released.

Figure 2:
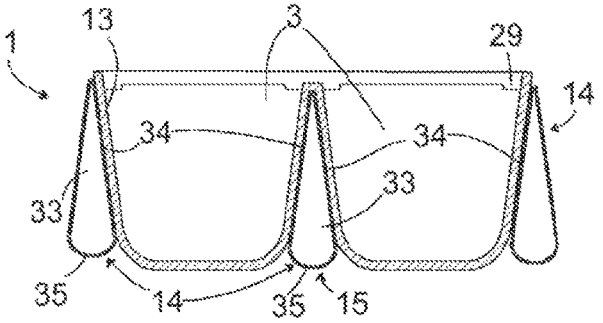
FIG. 2 shows a section through an ice maker tray according to a second embodiment of the invention.

FIG. 2 shows, in a section transversely relative to the pivot axis 31, a tray 1 according to a second embodiment of the invention. The walls of the cavities 3 are here not formed by interlocking inner and outer shells as in FIG. 1, but rather they each comprise a shell 13, in which the cavities 3 are hollowed out, and hollow bodies 14 fastened to the outer sides of the shell 13 and filled with phase change material 33.

The hollow bodies 14 can be flexible, elastically deformable hoses, which in each case extend transversely relative to the section plane over the entire length of the tray 1 and are able to adjust themselves to the available installation space, in particular in a gap 15 between the two rows of cavities 3, as long as the phase change material 33 contained therein is warm enough to be resiliently deformable.

According to one development, at least those surface regions 34 of the hollow body 14 are embodied rigidly, which are provided to come into contact with the shell 13, while other surface regions can be flexible in order to permit a thermal expansion of the phase change material 33, and the hollow bodies are removably fastened to the shell 13. When the cooling capacity of the hollow bodies 14 assembled on the shell 13 is exhausted after one or more ice production cycles, these can be removed in order to be cooled down again at another location in the refrigeration appliance, and be replaced by fresh hollow bodies 14.

Figure 3:
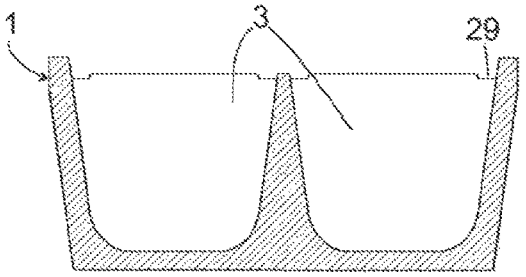
FIG. 3 shows a section through an ice maker tray according to a third embodiment.

FIG. 3 shows a cross-section through a tray 1 according to a third embodiment of the invention. Here, the tray 1 is injection molded in one piece from a mixture of a phase change material such as a paraffin with a matrix of polymer material. The mixing ratio of phase change material and polymer material is selected such that the tray is also solid above the melting point of the phase change material. Due to the homogeneous mixing, the liquid phase of the phase change material cannot be directly observed; the fact that a phase change takes place inside the tray 1 only indirectly shows that the thermal capacity of the tray 1 is strongly temperature-dependent and passes through a maximum in the surroundings of the melting temperature of the phase change material.

According to one variant, the material of the tray 1 is not homogeneous, but rather the phase change material is present in the form of small bubbles embedded in the matrix. A tray of this kind can be realized by injection molding an emulsion of matrix and phase change material.

It is also conceivable to manufacture the tray in FIG. 3 by first producing a granulate made of hollow plastic beads filled with the phase change material, mixing the granulate below the matrix and forming the resulting mixture into the tray 1.

In order for the granulate to pass through an injection nozzle without being destroyed, its graining must of course be considerably finer than the wall thickness of the tray 1.

Figure 4:
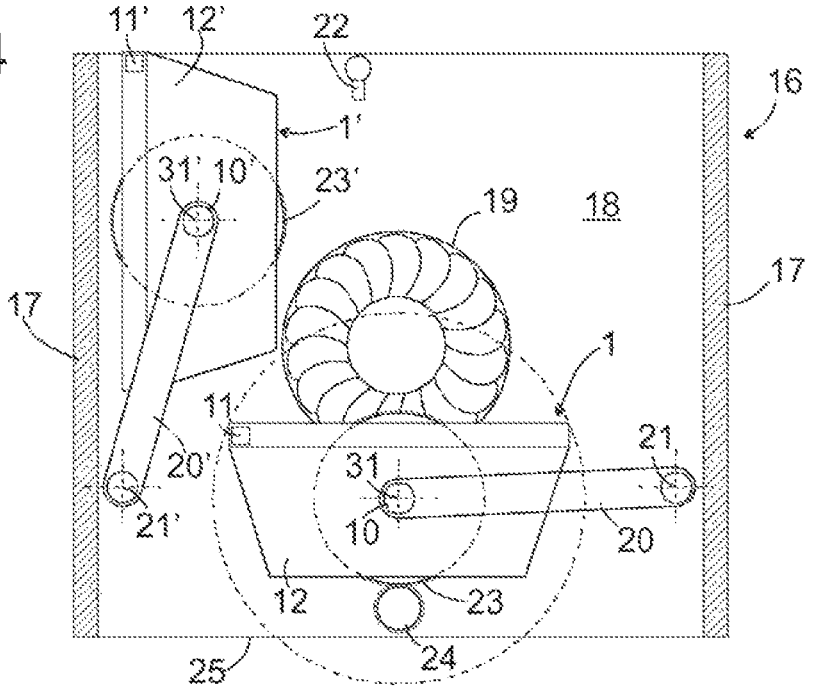
FIG. 4 shows a schematic cross-section through an automatic ice maker with two trays.
Figure 5:
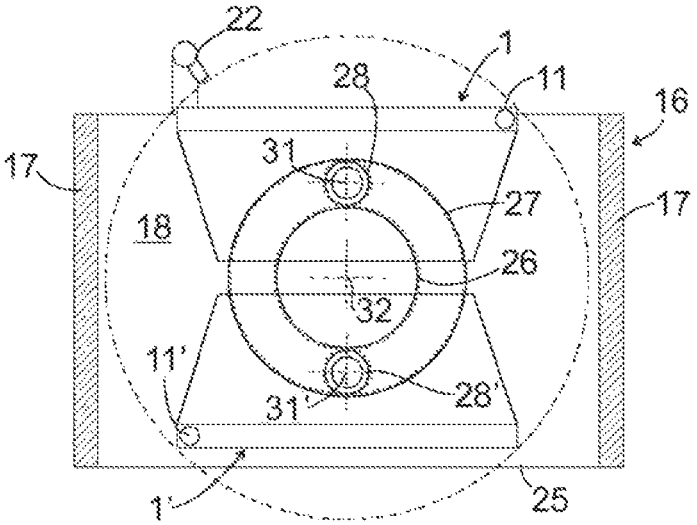
FIG. 5 shows a section, analogous to FIG. 4, through an ice maker with two trays according to a further embodiment of the invention.

The FIGS. 4 and 5 each show a schematic view of the configuration of an automatic ice maker with two trays 1, 1', in which in each case the tray may be according to any of the embodiments described above.

The ice maker in FIG. 4 comprises a shelf or rack 16, of which a section of two longitudinal walls 17 are shown in the Figure. A window 19 is hollowed out in an end wall 18 of the shelf 16 in order to supply the interior of the shelf 16 with cold air, driven by a fan installed in the shelf 16 or a fan of the refrigeration appliance, in which the ice maker is accommodated.

The two trays 1, 1' are located in said interior.

The trays 1, 1' are each held by two arms 20, 20' engaging in a pivotable manner about the axes 31 or 31' on their end faces, which arms 20, 20' for their part can be pivoted about axes 21, 21' fixed to the end walls 18 of the shelf 16. The tray 1 is located in a freezing position, below a fresh water outlet 22, via which the cavities of the tray 1 can be filled with liquid water. The cold air flow entering through the window 19 covers the surface of the water in the cavities of the tray 1, so that it freezes quickly, supported by a phase change of the phase change material in the walls of the tray 1. If the cold air flow spreads along the base of the tray 1', this is also effectively cooled. The tray 1' is unable to receive any water in the standby position shown, tilted above the tray 1 against the left longitudinal wall 17, but the phase change material contained therein also freezes in the standby position.

Both trays 1, 1' support the abutment projection 11, 11' explained with reference to FIG. 1 on their end face 12 or 12' facing toward the observer. On the opposing end face, a gear 23, 23' is non-rotatably connected to the tray 1 or 1'. In the freezing position, the gear 23 meshes with a gear 24, which can be driven by an electric motor concealed on the other side of the end wall 18, in order to pivot the tray 1, after the water therein has frozen, about the pivot axis 31 running through the peg 10 into an ejection position, in which the cavities are facing toward an ejection opening 25 on the underside of the shelf 16 and the abutment projection 11 comes up against an end stop of the end wall of the shelf 16 (not visible in FIG. 1). The gear 24 being driven further after reaching this ejection position means that the tray 1 is intrinsically twisted, the ice cubes are released from the cavities and fall into a container (not shown) below the ejection opening 25.

When this has happened, the shell 1 is pivoted about the pivot axis 31 back into the freezing position shown in FIG. 4 and then moved in mirror image to the standby position of the tray 1' shown in FIG. 4 by pivoting the arms 20 about the axis 21 into a standby position.

The phase change material is now completely frozen in the tray 1'. The tray 1' being pivoted into the freezing position brings its gear 23' into engagement with the gear 24. The tray 1' is filled via the fresh water outlet 22, and the water quickly freezes in contact with the phase change material of the tray 1' and the circulating cold air, while at the same time the tray 1 in the standby position also cools down. The emptying of the cavities of the tray 1' is in turn driven by a rotation of the gear 24.

A particularly space-saving configuration is shown by the embodiment in FIG. 5.

Here, a sun gear 26 and a ring gear 27 are mounted rotatably about an axis 32 on an end wall 18 of the shelf 16, and planetary gears 28 non-rotatably connected to the trays 1, 1' mesh with the sun gear 26 and ring gear 27. The upper tray 1 is in the freezing position, in which it can be filled via the fresh water outlet 22 and a cold air flow spreading over the shelf 16 can cool water in the cavities of the tray 1. In order to enable an efficient cooling also of the other tray 1' in the standby position below the tray 1 with cavities turned downward, windows can be provided in longitudinal walls 17 or end walls 18 of the shelf 16, depending on the circulation direction of the cold air.

After the water in tray 1 has frozen, the sun gear 26 and ring gear 27 are co-rotated by 180°, so that the trays 1, 1' change places. While the abutment projection 11' of the tray 1', now in the freezing position, can be moved in the radial direction, the abutment projection 11 of the tray 1, now in the ejection or standby position, engages into a groove concentric to the sun and ring gear 26, 27 on the end wall of the shelf 16 (not visible in the Figure) opposite the planetary gear train, which groove prevents a radial movement of the abutment projection 11. If one of the sun and ring gears is retained while the other is rotationally driven, the tray 1 is twisted and the ice cubes formed therein are ejected via the opening 25 on the base of the shelf 16.

At the same time as the twisting of the tray 1, a pivoting movement of the tray 1' is driven about the axis running through the gear 23' and the peg 10'. If the filling of the tray 1' only takes place afterwards, then this pivoting movement remains without any consequence. It can, however, also be used to connect the cavities 3 with one another temporarily, by the water in the filled cavities 3 flooding recesses 29 on the upper edges of the dividing walls 30 between them (see e.g. FIG. 1), ensuring a uniform filling of the cavities 3 as a result.

REFERENCE CHARACTERS

1 Tray
2 Shell
3 Cavity
5 Shell
6 Hollow space
7 Side wall
8 Side wall
9 Base
10 Base
11 Peg
12 Abutment projection
13 End face
13 Shell
14 Hollow body
15 Gap
16 Shelf
17 Longitudinal wall
18 End wall
19 Window
20 Arm
21 Axis
22 Fresh water outlet
23 Gear
24 Gear
25 Ejection opening
26 Sun gear
27 Ring gear
28 Planetary gear
29 Recess
30 Dividing wall
31 Pivot axis
32 Axis
33 Phase change material
34 Surface region
35 Surface region

The invention claimed is:

1. An ice maker, comprising:

a tray having at least one cavity formed therein for receiving water, said tray having a wall defining said cavity and said wall containing a phase change material, said tray having a pivot axis around which said tray is pivoted;

a further tray containing a phase change material, said further tray having a second pivot axis around which said further tray is pivoted; and a rack having a freezing position and an empty standby position, said empty standby position for carrying out a phase change of said phase change material, said tray and said further tray being supported in said rack and movable between said freezing position and said standby position, in each case, one of said trays is in said freezing position and said other tray is in said standby position, said pivot axis and said second pivot axis being moved during movement of said tray and said further tray between said positions.

2. The ice maker according to claim 1, wherein said phase change material is embedded in a matrix material of said wall.

3. The ice maker according to claim 1, wherein said wall has a hollow body which contains said phase change material.

4. The ice maker according to claim 1, wherein said tray and said further tray can be moved between the freezing position and the standby position by pivoting about a horizontal axis.

5. The ice maker according to claim 1, wherein said tray and said further tray at least partly overlap.

6. The ice maker according to claim 1, wherein:

said further tray has a further cavity formed therein; and said tray and said further tray cannot hold water when in said standby position.

7. The ice maker according to claim 1, wherein said rack has an ejection opening formed therein for ice cubes.

8. The ice maker according to claim 7, wherein said tray in the freezing position can be pivoted into an ejection position about an axis and can be twisted in the ejection position.

9. The ice maker according to claim 8, wherein said tray in the freezing position is disposed below said further tray in the standby position.

10. The ice maker according to claim 9, wherein said axis about which said tray can be pivoted into the ejection position can also be said axis about which said tray can be twisted.

11. The ice maker according to claim 7, wherein said tray in the freezing position is disposed above said further tray in the standby position.

12. The ice maker according to claim 11, wherein said tray in the freezing position can be moved into an ejection position below said further tray.

13. A refrigeration appliance, comprising:

an ice maker unit containing a tray having at least one cavity formed therein for receiving water, said tray having a wall defining said cavity and said wall containing a phase change material, said tray having a pivot axis around which said tray is pivoted;

a further tray, said further tray having a second pivot axis around which said further tray is pivoted; and a rack having a freezing position in which said pivot axis and said second pivot axis are in a first location and an empty standby position in which said pivot axis and said second pivot axis are disposed in a second location, said empty standby position for carrying out a phase change of said phase change material, said tray and said further tray being supported in said rack and movable between said freezing position and said standby position, in each case, one of said trays is in said freezing position and said other tray is in said standby position.

* * * * *